US007128059B2

(12) United States Patent
Phaneuf

(10) Patent No.: US 7,128,059 B2
(45) Date of Patent: Oct. 31, 2006

(54) AIR INDUCTION SYSTEM AND EVAPORATIVE EMISSIONS CONTROL DEVICE

(75) Inventor: Edward Phaneuf, Pontiac, MI (US)

(73) Assignee: Mahle Technology, Inc., Farmington Hills, MI (US)

( * ) Notice: Subject to any disclaimer, the term of this patent is extended or adjusted under 35 U.S.C. 154(b) by 0 days.

(21) Appl. No.: 11/035,462

(22) Filed: Jan. 13, 2005

(65) Prior Publication Data

US 2005/0150475 A1 Jul. 14, 2005

Related U.S. Application Data

(60) Provisional application No. 60/536,289, filed on Jan. 13, 2004.

(51) Int. Cl.
*F02M 37/04* (2006.01)

(52) U.S. Cl. ..... 123/516; 123/337; 261/44.5; 137/219

(58) Field of Classification Search ..... 123/337, 123/516, 518, 519, 520, 198 D; 137/219, 137/220, 221; 261/DIG. 56, DIG. 29, 44.5
See application file for complete search history.

(56) References Cited

U.S. PATENT DOCUMENTS

RE27,324 E * 3/1972 Granger ..... 180/176
3,792,713 A * 2/1974 Zadoo ..... 137/486
4,128,087 A * 12/1978 Hayashi et al. ..... 123/337
5,029,564 A * 7/1991 Neutzer ..... 123/337
5,035,222 A * 7/1991 Feldinger ..... 123/452
5,090,390 A * 2/1992 Feldinger ..... 123/494
6,152,115 A 11/2000 Busato et al.
6,367,457 B1 4/2002 Mancini et al.
6,422,191 B1 7/2002 Braun et al.
6,571,780 B1 * 6/2003 Jones et al. ..... 123/564
6,578,564 B1 6/2003 Banasco
6,640,770 B1 11/2003 Woody
6,679,228 B1 1/2004 Confer
6,892,997 B1 * 5/2005 Kreuter ..... 251/129.16

* cited by examiner

*Primary Examiner*—Carl S. Miller
(74) *Attorney, Agent, or Firm*—Collard & Roe, P.C.

(57) ABSTRACT

A device comprising an air intake duct and at least one passive one-way air intake valve disposed in the air intake duct. There is also an actuator coupled to the one-way valve for biasing the one-way valve in a closed position. During operation, the one-way air intake valve is opened via an air induction force created by operation of an internal combustion engine positioned downstream from the actuator. This one-way air intake valve is closed after the internal combustion engine has stopped operating to prevent emissions of evaporated hydrocarbons from the engine through the air induction system. The valve can also be moved into a fail-safe position if the actuator fails but the engine is operating.

6 Claims, 4 Drawing Sheets

AIR INDUCTION SYSTEM AND EVAPORATIVE EMISSIONS CONTROL DEVICE

CROSS REFERENCE TO RELATED APPLICATIONS

This application hereby claims priority under 35 U.S.C. 119e and is a conversion of U.S. Provisional Application Ser. No. 60/536,289 filed on Jan. 13, 2004 the disclosure of which is hereby incorporated herein by reference.

BACKGROUND OF THE INVENTION

The device relates to a passively activated valve for a spark ignition internal combustion engine to control evaporative emissions. This device can be designed to prevent the escape of hydrocarbons from the engine to the atmosphere through the air induction system. This device requires no control from the engine management system. This valve is a failsafe valve wherein the engine will always operate even upon a valve actuation failure.

Other types of systems for preventing evaporative emissions are known in the art. For example, U.S. Pat. No. 6,679,228 to Confer et al discloses a low evaporative emissions integrated air fuel module the disclosure of which is hereby incorporated herein by reference. In addition other evaporation systems are known such as, U.S. Pat. No. 6,640,770 to Woody, U.S. Pat. No. 6,422,191 to Braun et al, U.S. Pat. No. 6,367,457 to Mancini et al; U.S. Pat. No. 6,578,564 to Banasco and U.S. Pat. No. 6,152,115 to Busato et al the disclosures of these patents are hereby incorporated herein by reference.

SUMMARY OF THE INVENTION

The invention relates to a one way check valve that is positioned in an air intake duct for an internal combustion engine. This valve can be actuated by a vacuum actuator that is plumbed to an intake manifold vacuum port via a vacuum hose.

This valve is designed so that even if a vacuum was not supplied to the vacuum actuator during engine operation, air drawn into the engine due to the operational characteristics of conventional spark ignition combustion engines would overcome this vacuum actuators actual spring force.

The spring force is used to seat the valve and prevent the escape of hydrocarbons out of the engine through the air induction system when the engine is not in use. With a spark ignition engine, there can be the creation of a vacuum in the internal combustion engine's intake manifold, which may then be used to open the valve. During operation, and with normal operating conditions, the valve would remain open so that air would be allowed to flow past the valve into the internal combustion engine. However during operating conditions, there are some occasions when there is little or no pressure difference between the intake manifold and the surrounding atmosphere. At this point the valve actuator would move towards a closed position. When this valve actuator is not in an opened position, the engine operation will still be possible as the air flow demand from the engine will work directly on the valve body causing it to open however, air induction system restriction could be increased.

To keep the valve open, a second check valve is placed between the intake manifold and the vacuum actuator allowing the valve to fully open and remain fully opened under any normal engine operating conditions. So that the first valve will close after the engine shut down, a small controlled leak is present in the second check valve. This leak can be such that it allows the air induction valve to close after any predetermined time from initial engine shutdown. At this point, the vacuum within the intake manifold relative to the atmospheric pressure no longer exists. At this point, air will eventually leak back into the vacuum actuator and allow the air induction system valve to close and seal the air induction system preventing the escape of hydrocarbons from the engine through the air induction system.

One of the benefits of this design is that a hydrocarbon adsorber can be replaced with a low cost valve as a means to trap hydrocarbons emitted from the fuel injectors and the engine crankcase after the engine shut down.

Additionally this system offers an advantage over barrier style adsorbers in that it is not sensitive to contamination which may lead to a reduction in adsorption performance and or ever increasing air induction system restriction over the life of the vehicle.

In use, the valve operation on the vehicle is essentially transparent to the driver, such that the valve is a fail-safe valve so that if the actuator were to fail, the vehicle would continue to operate.

The air intake valve adds a relatively low pressure drop to the system and this pressure drop can be optimized without affecting the functionality of the valve.

The valve closes after engine operation ceases, thus a complete seal is formed.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
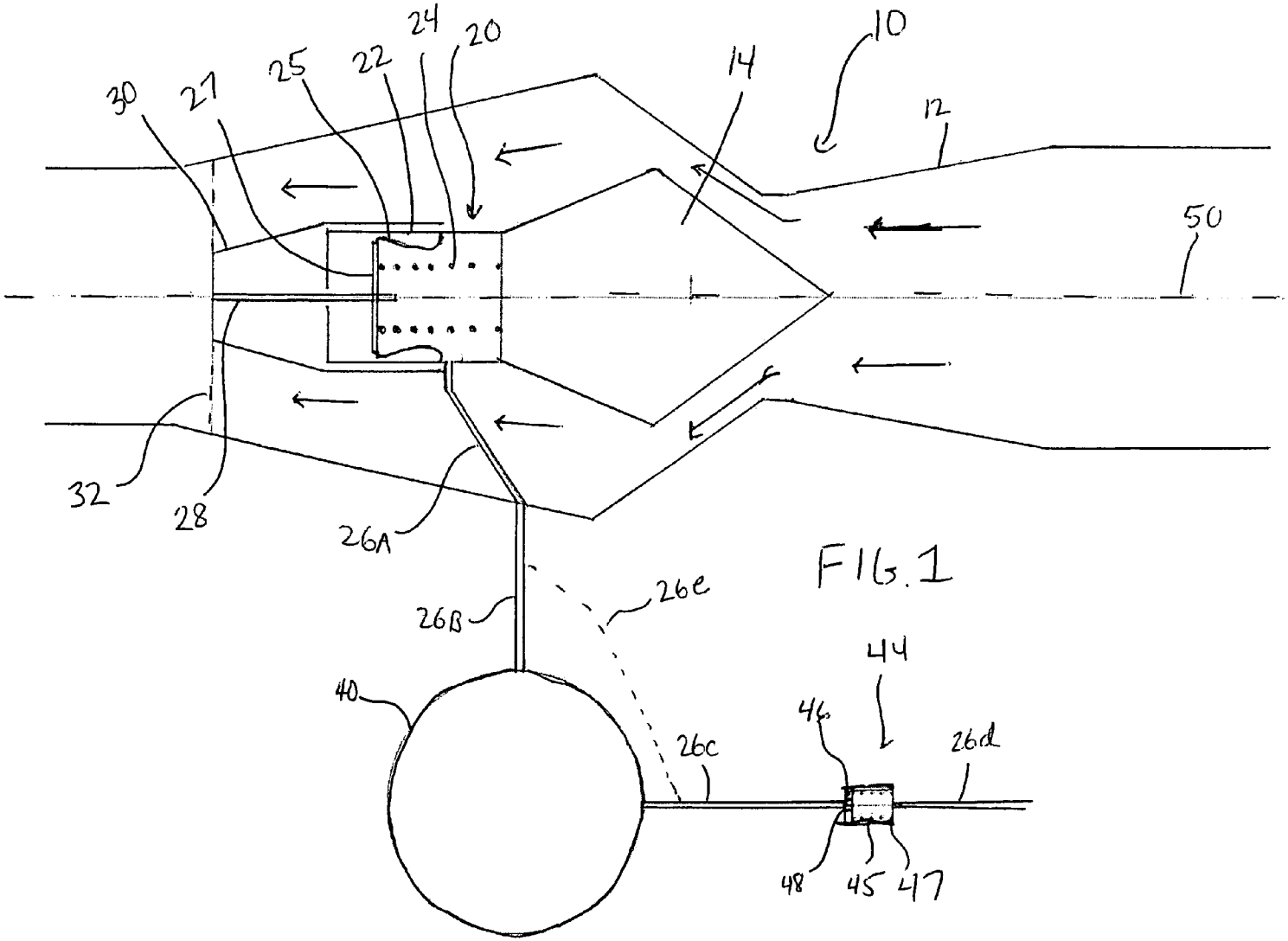
FIG. 1 is a cross sectional view of the valve system in an open position.

Turning now in detail to the drawings, FIG. 1 shows a side cross-sectional view of the device 10 which includes the air induction valve for an engine air induction system. With this design, there is an air intake duct 12 which is connected downstream with respect to air flow from an air filter. This air intake duct is formed in a substantially cylindrical manner and can be used to house a valve 14 which is disposed in such a way that it may slide along an axis 50 defined by air intake duct 12.

Valve 14 can be formed as a modified cylindrically shaped device having a narrowed end that is substantially conically shaped so that valve 14 can be seated against air duct 12 in a sealing manner.

Valve 14 is coupled to a vacuum actuator 20 which includes a vacuum actuator housing 22, at least one spring 24 disposed inside of this vacuum actuator housing 22, at least one vacuum tube 26*a* coupled to vacuum actuator housing or cylinder 22 and a diaphragm 25. Vacuum tube 26*a* can be used to plumb, or connect in a fluid manner, the intake manifold to vacuum cylinder 22 thereby providing a vacuum source to the vacuum actuator housing 22 when an internal combustion engine has started (See FIGS. 4A and 4B). Actuator 20 can also include a base plate 27 which is connected to a shaft 28. Diaphragm 25 is coupled in a sealing manner at one end to vacuum cylinder 22 and in a sealing manner at the opposite end to base plate 27. When diaphragm 25 contracts, it compresses against spring 24 pulling on vacuum chamber 22 and thereby pulling valve 14 axially into actuator support 30.

When this occurs, air is drawn through duct 12 past valve 14 from the atmosphere via the movement of pistons within the cylinders in the internal combustion engine in a known manner. Under most engine operating conditions there does exist a significant pressure difference between the intake manifold and atmosphere. The pressure difference is due to the restriction associated with the throttle position, therefore as throttle restriction is reduced, intake manifold pressure increases towards atmospheric pressure and as the throttle restriction is increased, intake manifold pressure decreases to some value significantly below atmospheric pressure. Therefore, the pressure within the intake manifold can be used as a vacuum source relative to atmospheric pressure for the vacuum actuators operation. With vacuum actuator 20 plumbed to the intake manifold, actuator 20 can then move axially inside of the actuator support 30 in turn moving valve 14.

To control the movement of the actuator, there is an outflow pipe or tube 26*a* that is coupled to the vacuum or actuation chamber 22 wherein this tube 26*a* could extend out of vacuum chamber 22. Tube 26*a* can be made from a material that is bendable or formable into different positions to accommodate the movement of valve 14 inside of air duct 12. For example, tube 26*a* could be formed from a rubber material. Tube 26*b* connects to tube 26*a* outside of air duct 12. Tube 26*b* could either be formed continuously from the same material as tube 26*a* or as a different part coupled to tube 26*a*. Tube 26*b* extends into a vacuum reservoir 40 allowing air or fluid to flow from vacuum chamber 22 through tube 26*a*, then through tube 26*b* on to Vacuum reservoir 40. The air or fluid can then flow from vacuum reservoir 40 through outflow tube 26*c* and out of vacuum reservoir 40 and into additional check valve 44, to the engine intake manifold.

Additional check valve 44 includes a valve body 46 which is biased in a closed position via a spring or actuation element 45. Additional check valve 44 resides in an additional check valve container 47 which houses check valve body 46.

Additional check valve 44 is used to prevent the excess flow of air back into the vacuum reservoir 40 and vacuum actuator 20 when intake manifold pressure exceeds the pressure in vacuum reservoir 40 and vacuum actuator 20 so that valve 14 will remain in an open position during engine operation.

Additional check valve 44 is designed with a controlled leak. This controlled leak is in the form of a perforation or gap 48 in valve body 46 which allows a limited amount of air to flow past valve body 46 even when valve body 46 is in a closed position. This controlled leak can be used to allow the pressure within vacuum actuator 20, vacuum reservoir 40, and tubes 26*a*, 26*b* and 26*c* to increase up to a point (and eventually to atmospheric pressure) at which the internal spring 14 force is able to over come the force due to pressure within the vacuum actuator 20 thus allowing the valve 14 to close/seal against the air intake duct 12.

FIG. 1 also shows an optional alternative design wherein a tube 26*e* can be used to connect tube 26*a* to valve 44. Thus in this design, there would be no use of vacuum chamber 40. Rather there would be direct fluid communication between vacuum chamber 22 and additional check valve 44.

Figure 2:
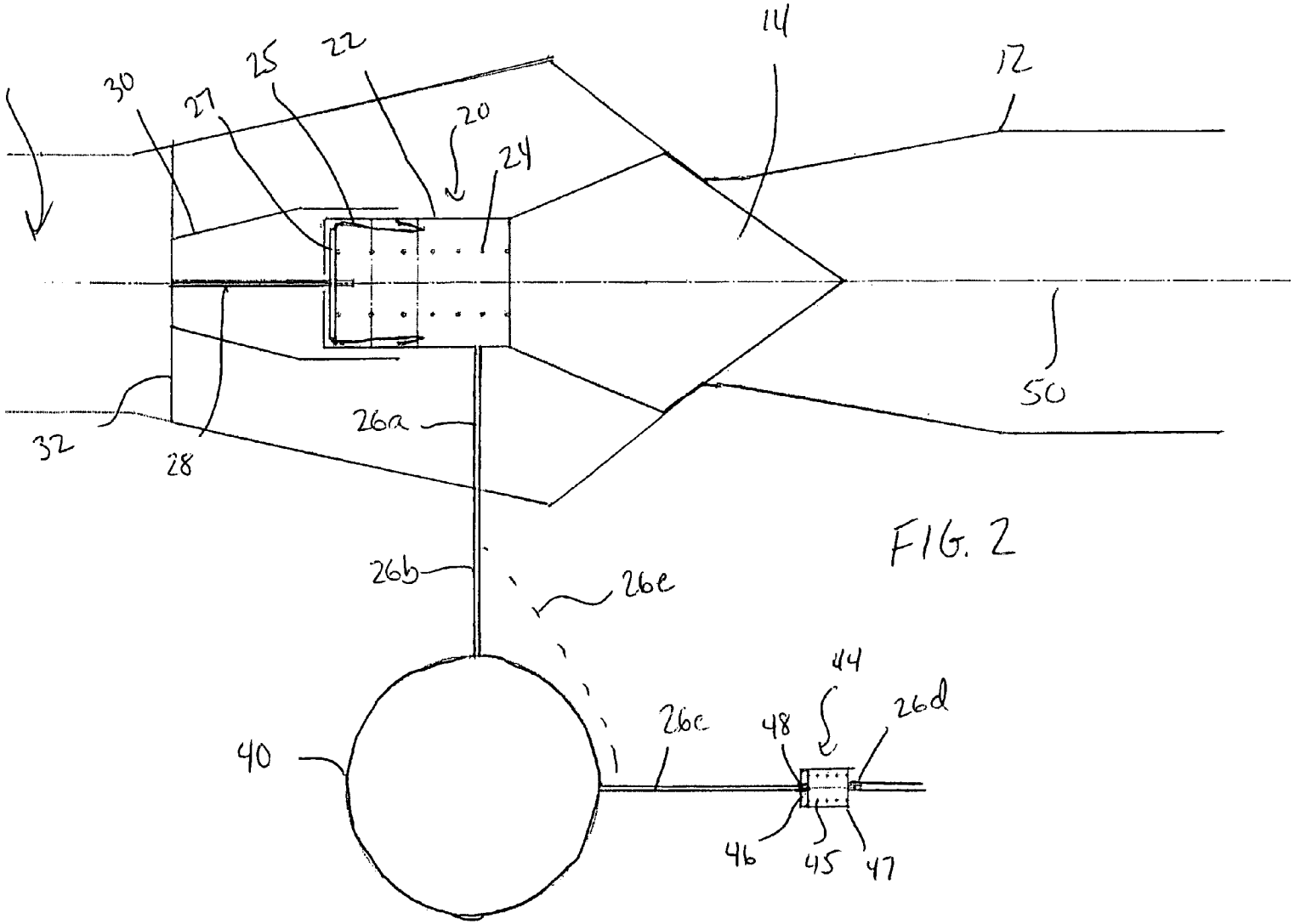
FIG. 2 is a cross-sectional view of the valve system in a closed position.

FIG. 2 shows valve 14 in its closed position wherein valve 14 forms a sealing fit against intake duct 12 closing off an annular opening surrounding valve 14. Valve 14 contacts air intake duct 12 in a narrowed section of duct 12 which forms a valve seat which allows valve 14 to seal against any flow back through the air intake duct 12 of evaporated hydrocarbons present inside of an internal combustion engine. This closed position occurs when the engine has been shut off for awhile allowing the pressure between the outside air and the pressure inside of the vacuum chamber to equalize. The controlled leak in valve 44 can be used to regulate the closing of valve 14 such that leak 48 is designed with a sufficient leak rate and size to allow closure of valve 14 after at least one minute after an engine shuts off. In addition, this controlled leak could be made to provide closure of valve 14 between one and (x) minutes after an engine shuts off. For example, the term (x) could be set at three minutes, or at any other desired time. Essentially the term (x) could be set at a level so that it would not hinder normal engine performance.

Figure 3:
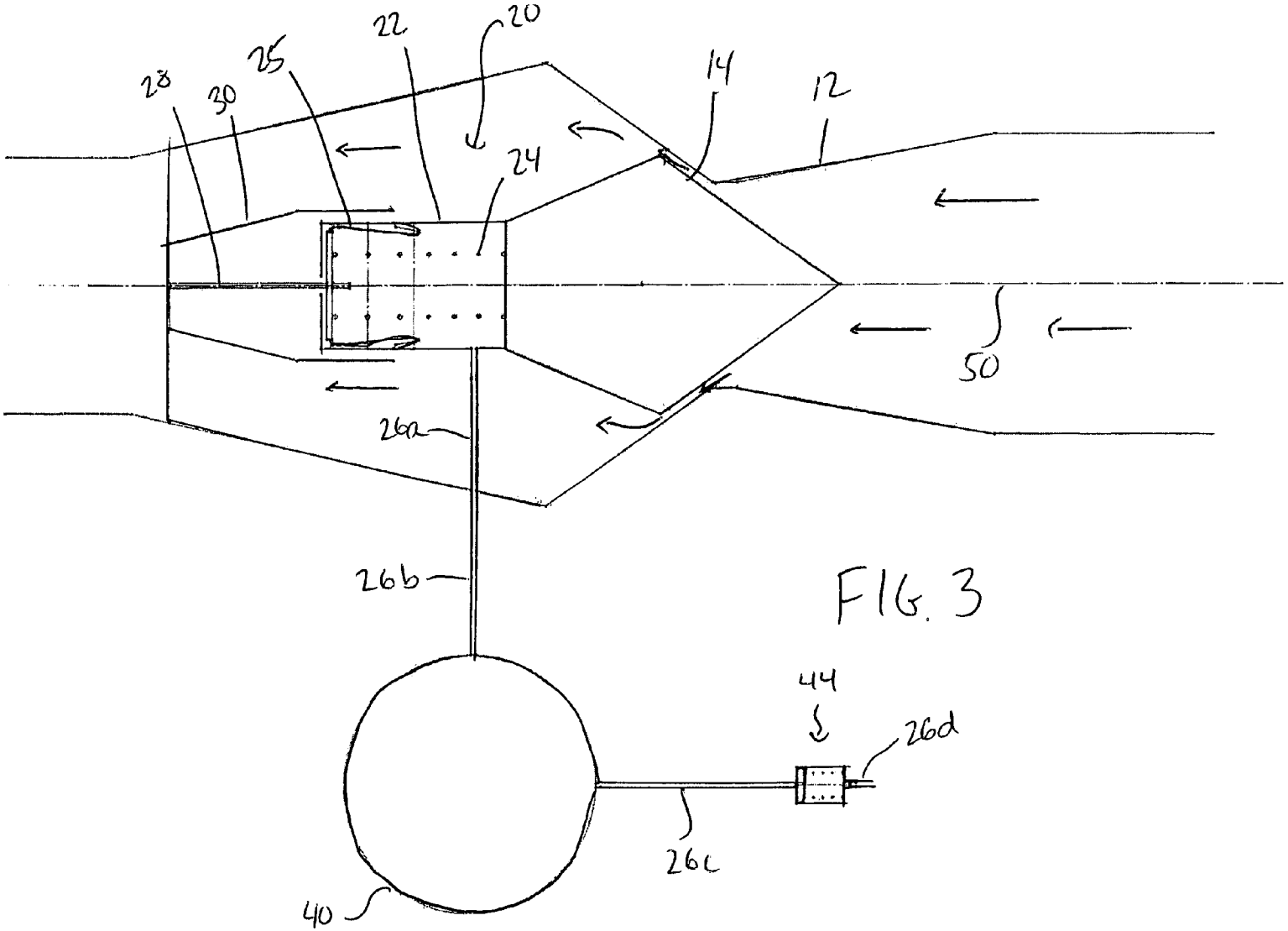
FIG. 3 is a side cross-sectional view of the valve system in a fail-safe position.

One of the main benefits of the design of this valve system is that even if actuator system 20 fails, the valve can still open upon both the start and continuing operation of an engine. FIG. 3 shows valve 14 in a fail safe position. In this case, actuator system would have either partially or fully failed wherein spring 25 would not be acted on via the vacuum created in the actuator system. Instead, the air flow and corresponding pressure differential between the outside air and the lower pressure created by the operation of the internal combustion engine would create a suction force against valve 14 pushing valve 14 against spring 25 and forcing valve 14 into an open position. In this case, the fail-safe position of valve 14 may not be open as wide as when the actuator 20 is fully working, but this fail safe opening of the valve prevents any major problems and even engine operation failure that may otherwise be associated with a failure of actuator system 20.

To accommodate both the open position when actuator 20 is fully operational, or the fail safe position when actuator 20 has failed, spring 25 is designed so that it is of sufficient strength to close valve 14 when the engine is not operating, but spring 25 is also designed of sufficient flexibility to open at the pressure differential created by the engine either in vacuum housing 22 when actuator 20 is working or across the air duct in the fail safe mode.

Figure 4A:
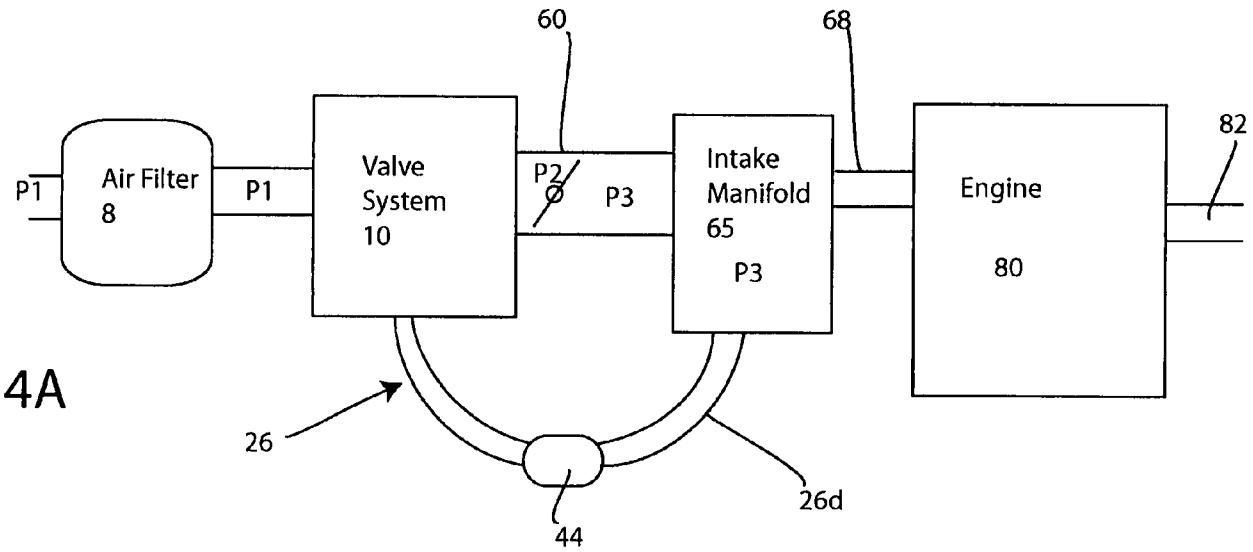
FIG. 4A is a flow diagram of one embodiment of the invention.

FIG. 4A discloses a flow chart diagram disclosing a first embodiment showing the valve system device 10 positioned downstream with respect to operating air flow from an air filter 8. In this design, the device 10 is positioned upstream from a throttle body 60 which shows a throttle in a partially open position. Positioned downstream from throttle body 60 is intake manifold 65 which is used to receive air intake into an internal combustion engine 80. Downstream from engine 80 is an exhaust output.

Intake manifold 65 is in fluid or air communication with throttle body 60 and also with actuator 20 via tubing 26 which can include tubes 26*a*, 26*b*, 26*c* or also 26*e* as described above. This tubing 26 feeds into additional valve 44 as shown in FIGS. 1–3. Additional valve 44 is in fluid or air communication with intake manifold 65 via tubing 26*d*. The actual connection between actuator 20 and intake manifold 65 is in a more direct manner via tubing 26 than via throttle body 60. Therefore, this connection via tubing 26 bypasses throttle body 60 and can therefore create a greater and more direct pressure drop and vacuum pressure inside of actuator 20 than just via the difference in pressure from a connection between device 10 and intake manifold 65 via throttle body 60. This is because under normal operating conditions there can be a significant pressure differential and an accordingly significant pressure drop across throttle body 60.

Figure 4B:
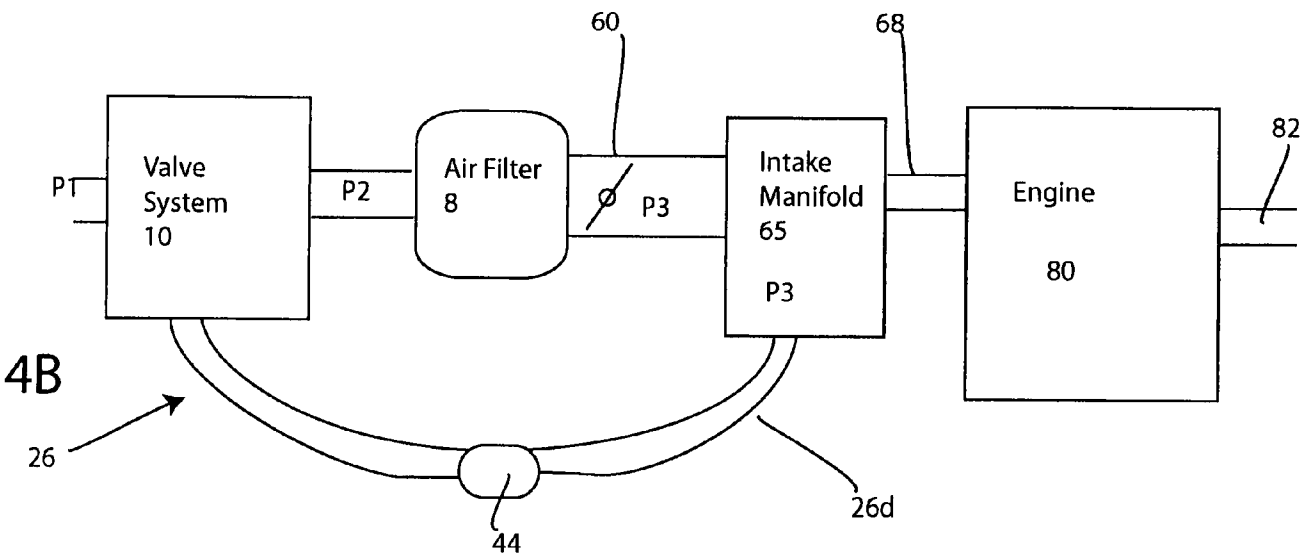
FIG. 4B is a flow diagram of another embodiment of the invention.

Therefore, as disclosed, in FIGS. 4A and 4B there are different pressures P1, P2, and P3 in an engine across different parts of the engine. In this case, there is an outside pressure P1 which would be atmospheric or nearly atmospheric pressure. The pressure immediately after valve system 10 would be P2 which under engine operating conditions would be lower than pressure P1 due to the operation of engine 80. Because there is a significant pressure difference between a position upstream from throttle body 60 and downstream from throttle body 60 the pressure P3 would therefore be significantly lower than pressure P2 when the engine is in operation. This significant difference can be for example 15 inhg less than atmospheric pressure under a normal engine operation as is known in the art.

The direct connection between valve system 10 and more particularly actuator 20, and intake manifold 65 via tubing 26 and additional valve 44 creates a direct pressure drop connection between an original atmospheric pressure P1 which is the pressure inside of vacuum chamber 20 before engine 80 starts, and the pressure P3 inside of intake manifold 65 after the engine starts. Because the pressure difference between P1 and P3 is much greater than the pressure difference between P1 and P2, which is the pressure just before throttle body 60, actuator 20 acts under a powerful vacuum and can provide a much greater opening means than the simple air flow across valve 14 when the device operates in a fail safe manner.

In operation, the device functions as follows, when a user starts an engine, the pull or vacuum created by the movement of pistons inside of an engine create a corresponding pressure drop inside of intake manifold 65. This creates a draw or vacuum inside of tubing 26*d* which then causes additional valve 44 to open such that this vacuum pressure pulls on valve body 46 and causes it to compress against springs 45. Once valve 44 is open, a vacuum is created inside of vacuum housing 40 and also vacuum chamber 22 causing diaphragm 25 to contract pulling base plate 27 onto spring 24 resulting in the compression of spring 24 and a resulting movement of valve 14 axially into an open position. This axial movement is controlled via axial support 30 which acts as an alignment means. Once the vacuum has been created, and the valve is in an open position, air can flow from an outside source into the engine to allow the combustion inside of the engine.

If the engine is particularly stressed or is operating at a level near or at full throttle, the pressure differential between pressure P2 and pressure P3 can be minimized. At that point, the vacuum pulling force inside of actuator chamber 22 could also theoretically be reduced. To prevent actuator 20 from failing or closing too rapidly during operation, additional valve 44 would close first, essentially sealing actuator 20 from intake manifold 65 during engine operation. At this point actuator 20 would still act on valve 14 to keep it in its open position but additional valve 44 would remain closed.

When the engine is no longer at full throttle, the pressure difference between pressure P2 and P3 would rise again creating this vacuum condition again and thereby opening valve 44 again. Thus, spring 45 is designed to be sufficiently movable so that valve 44 opens under normal operating conditions, but sufficiently strong to close valve 44 when the pressure P3 increases to approach outside pressures P1 and P2.

When the engine has shut down, the pressure difference between P2 and P3 would drop because the engine would no longer create a pull or vacuum pressure on the system. In this case, additional valve 44 would move into a closed position. At this point, valve 14 would remain open because of the trapped vacuum inside of vacuum cylinder 22. To alleviate this trapped vacuum inside of vacuum cylinder 22, the controlled leak in valve body 46 would allow the pressure between the engine, and the vacuum cylinder to normalize allowing the diaphragm to open, and the spring to expand causing valve 14 to move into its closed position as shown in FIG. 2.

When the valve system as described above is in its closed position, it can be used to effectively block the flow of evaporated hydrocarbons out of an engine when the engine is not operating. However, this valve system is also beneficial because it can operate in a fully functioning mode when an actuator is working or in a fail safe mode thus preventing any major disruption to an operator of an engine using this valve system.

Accordingly, while a few embodiments of the present invention have been shown and described, it is to be understood that many changes and modifications may be made thereunto without departing from the spirit and scope of the invention as defined in the appended claims.

What is claimed is:

1. A device comprising:

a) an air intake duct;

b) at least one, one-way air intake valve disposed in said duct; and c) an actuator coupled to said at least one, one-way valve for biasing said one-way valve in a closed position;

d) at least one additional one-way valve in communication with, and disposed between said intake manifold and said vacuum actuator;

e) at least one partial leak disposed in said at least one additional one-way valve, wherein said leak is designed to allow pressure to equalize between an inside of said vacuum actuator and a pressure present within said engine intake manifold, wherein said pressure within said intake manifold is equal to atmospheric pressure when said engine is not operating;

wherein during operation, said actuator opens said at least one, one-way air intake valve via the presence of a lower pressure in an air intake manifold with respect to atmosphere due to operation of an internal combustion engine positioned downstream from said actuator, and wherein said actuator closes said at least one, one-way air intake valve after said internal combustion engine has stopped operating to prevent emissions of evaporated hydrocarbons from said engine through the air induction system.

2. The device as in claim 1, wherein said at least one, one-way air intake valve is slidably positioned in said vacuum container.

3. The device as in claim 1, wherein said at least one, one-way air intake valve is substantially conically shaped and forms an annular opening in said air intake manifold when said at least one, one-way air intake valve is in an open position.

4. The device as in claim 1, wherein said air intake duct is connected up or down stream of the air filter, and upstream of the throttle body.

5. The device as in claim 1, wherein said at least one partial leak is designed with a sufficient size so that said at least one, one-way air intake valve moves into a closed position at least one minute after engine shutdown.

6. The device as in claim 1, wherein said at least one partial leak is designed with a sufficient size so that said at least one, one-way air intake valve moves into a closed position at least three minutes after engine shutdown.

* * * * *